US006609261B1

(12) United States Patent
Mortensen et al.

(10) Patent No.: US 6,609,261 B1
(45) Date of Patent: Aug. 26, 2003

(54) FIRE RETARDANT MATTRESS WITH BURST-RESISTANT SEAM

(75) Inventors: John Mortensen, Little Silver, NJ (US); Cindy Colucci, Piscataway, NJ (US); Edward Tierney, West Milton, PA (US); Janet Jones, Milton, PA (US)

(73) Assignee: Claude V. Offray, Jr., Summit, NJ (US)

( * ) Notice: Subject to any disclaimer, the term of this patent is extended or adjusted under 35 U.S.C. 154(b) by 0 days.

(21) Appl. No.: 10/189,666

(22) Filed: Jul. 3, 2002

(51) Int. Cl.[7] ..... A47C 27/00
(52) U.S. Cl. ..... 5/698; 5/739; 428/920
(58) Field of Search ..... 5/698, 700, 483, 5/954, 739, 657.5; 297/DIG. 5; 428/920, 921

(56) References Cited

U.S. PATENT DOCUMENTS

| | | | | | |
|---|---|---|---|---|---|
| 3,273,177 | A | * | 9/1966 | Newton | 297/DIG. 5 X |
| 3,818,520 | A | * | 6/1974 | Richards, Jr. | 5/698 |
| 3,818,521 | A | * | 6/1974 | Richards, Jr. | 5/698 |
| 3,854,983 | A | * | 12/1974 | Brodnyan | 428/921 X |
| 3,889,305 | A | | 6/1975 | Goldberg | 5/698 |
| 3,934,285 | A | * | 1/1976 | May | 428/921 X |
| RE29,630 | E | | 5/1978 | May | 427/393.3 |
| 4,294,489 | A | | 10/1981 | Anolick et al. | 297/452.1 |
| 4,430,765 | A | | 2/1984 | Karpen | 5/698 |
| 4,504,991 | A | * | 3/1985 | Klancnik | 5/698 |
| 4,623,571 | A | | 11/1986 | Yamamoto et al. | 428/68 |
| 4,746,565 | A | | 5/1988 | Bafford et al. | 442/243 |
| 4,882,213 | A | * | 11/1989 | Gaddis et al. | 297/DIG. 5 X |
| 4,883,701 | A | * | 11/1989 | Rankin et al. | 5/483 X |
| 4,885,200 | A | * | 12/1989 | Perdelwitz, Jr. et al. | 428/920 X |
| 4,891,454 | A | * | 1/1990 | Perdelwitz, Jr. et al. | 428/920 X |
| 4,892,769 | A | | 1/1990 | Perdelwitz et al. | 428/68 |
| 5,279,878 | A | | 1/1994 | Fottinger et al. | 428/102 |
| 5,290,619 | A | * | 3/1994 | Siegel et al. | 5/739 X |
| 5,331,697 | A | * | 7/1994 | Siegel et al. | 5/739 |
| 5,472,766 | A | * | 12/1995 | Siegel et al. | 5/739 X |

* cited by examiner

*Primary Examiner*—Robert G. Santos
(74) *Attorney, Agent, or Firm*—Barry G. Magidoff; Paul J. Sutton

(57) ABSTRACT

A mattress resistant to bursting at the seam binding joining the upper and side tickings when subjected to flame conditions, is disclosed. The binding includes a tape overlying the junction of the fabrics defining the top and side tickings. The tape and ticking components are held together by a stitching thread such as lock stitching penetrating the tape, the ticking junctures and the tape again at an opposite side of the binding. The tape is selected to be thermoplastic, fire retardant and flowable at a temperature substantially lower than the char temperature of the thread which is thermo set. As a result of this combination, a flame directed against the binding will first induce the thermoplastic tape to melt and flow around and into the binding thread protecting the thread from charring and consequently losing its tensile strength for a significant period of time.

4 Claims, 3 Drawing Sheets

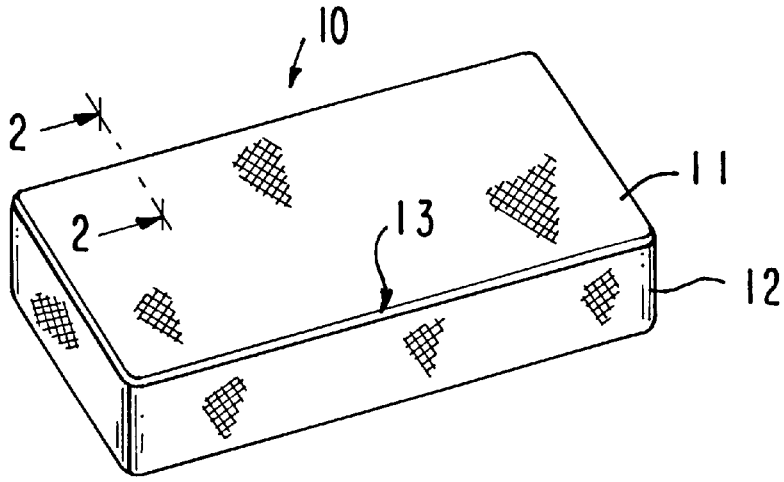
FIG. 1
FIG. 2
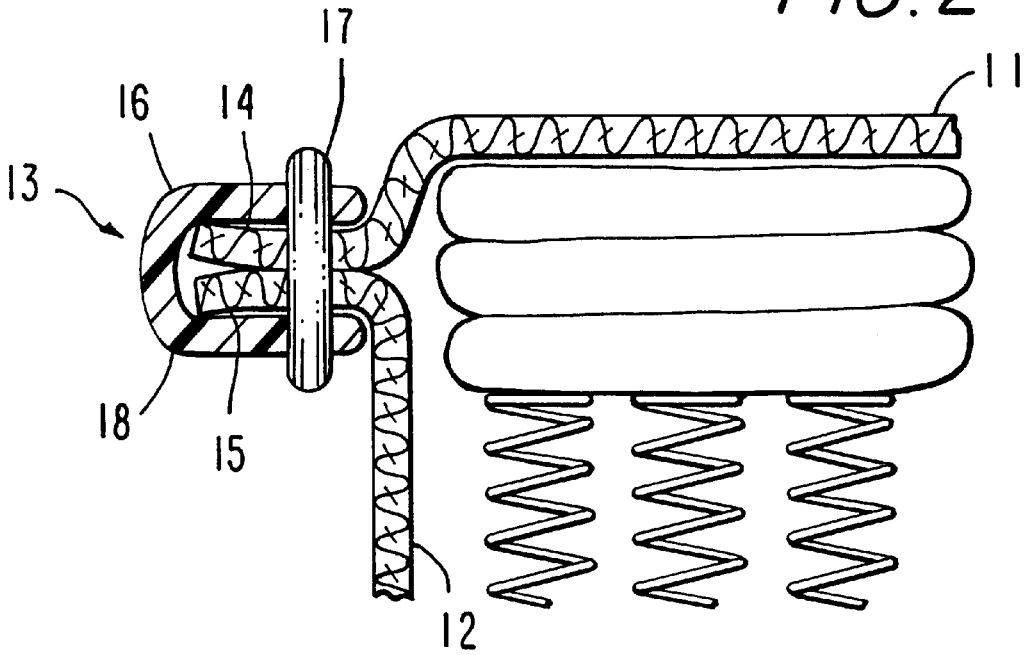

FIRE RETARDANT MATTRESS WITH BURST-RESISTANT SEAM

BACKGROUND OF THE INVENTION

The present invention is directed to a mattress structure which is resistant to catastrophic incineration when subjected to flame. More particularly, the invention is directed to a mattress having a novel binding assembly linking the upper and lower surfaces of the mattress to the horizontal ticking components surrounding the mattress.

Catastrophic fires involving mattress components are too frequent in occurrence. While all mattress fires are dangerous, a conflagration which impinges upon the binding seam linking the upper and side ticking components is far more dangerous then a fire which penetrates a central portion of the ticking. A centrally disposed burn-through is likely to result in smoldering confined to the ticking and perhaps a small amount of the batting which registers with the penetration. Such burn-through occurrences, which often result from a cigarette contacting the mattress, are typically, sufficiently slow-burning as to arouse the occupant of the bed before significant damage results.

A far more dangerous conflagration will arise when the flame and/or burn-through encounters the binding seam linking the upper and side ticking. This is because when the binding is compromised, compressed batting will rapidly release the connection between ticking components enabling the batting to extrude through the opening. The extruded batting, typically formed of cotton, polyester, or many types of materials including foams, is especially subject to rapid burning when expanded, increasing exposure to oxygen. There is accordingly a need for an improved binding assembly linking the major surfaces of the mattress to the ticking, which binding is resistant to rupture, and thus reducing the possibility of the consequent extrusion of the batting, when the binding is subjected to high heat and flame conditions.

Prior Art

Conventional known mattress seam constructions for linking the side ticking to the major mattress surfaces, are formed by placing the margins of the top and side ticking into juxtaposed relation either in edge to edge relation or with each of the tickings rolled back to provide double layers. Thereafter, a decorative tape is superposed over the ticking edges and a thread is stitched to the assembly, the thread penetrating the tape, the edges or folds of the two ticking components, and thereafter exiting through the tape. The physical structure of the binding of the instant invention is essentially conventional corresponding to the description above.

Patent Prior Art

A number of patent references developed by a search of the prior art have been located. The references developed are noted below:

U.S. Pat. No. 3,889,305 is directed to a mattress having a fabric to be used as an edging. The fabric comprises at least 50% monofilaments and optionally some spun yarns, the composition of the filaments being one or more of those set forth at column 9, lines 43 et seq. of the patent. The lift of the fabric is said to be such that the ratio of fabric thickness to average thickness of the monofilaments is from 2.5 to 1 to 4.5 to 1, the fabric weighing between 6 and 20 ounces per square yard.

U.S. Pat. No. 4,430,765 discloses a flame-retardant mattress of the type which is free of metallic components, i.e., for use in prisons or other environments where the metals could be used as weapons. This patent teaches the use of a tubular, perimeter portion, which incorporates a fire-retardant such as boric acid.

U.S. Pat. No. 4,294,489 is directed to a process for improving the flame resistance of certain fabrics. In accordance with this patent a layer of neoprene foam is applied to the fabric, the neoprene being capable of evolving water at combustion temperatures. The water is said to cool the affected area. The layer is said to form a thermally-insulating char which maintain its structural integrity.

U.S. Pat. No. 4,623,571 discloses a flame-proofing layer bonded to a reinforcing layer. The layers carbonize without melting.

U.S. Pat. No. 5,279,878 is directed to a flame barrier formed of non-woven fabric comprised of non-meltable partly graphitized polyacrylinitrile fibers bonded by a water jet needling technique.

U.S. Pat. No. 4,892,769 discloses a fire-resistant article namely a baby seat having a core comprising thermoplastic material having the fillers included therein such as wood or pulp. The fibers are deposited on a non-woven thermoplastic facing and heated to bind the core fibers to the thermoplastic sheet and to themselves. The integrity of the sheet is said to be maintained under high heat conditions. The seat includes a core having fire-resistant material, a liquid permeable facing sheet on one side and a liquid impermeable sheet on the other side.

Reissue patent 29,630 suggests rendering mattress fabrics fire-resistant by coating a surface of the fabric with a binding material having quantities of aluminum or graphite incorporated therein.

U.S. Pat. No. 4,746,565 is directed to a fire-retardant fabric comprising a self-extinguishing face fabric laminated to a glass fiber fabric. The glass fibers are coated to enable handling and prevent abrasion between adjacent glass yarns.

SUMMARY OF THE INVENTION

The present invention may be summarized as directed to a mattress assembly having improved binding seams linking the ticking component of the top and bottom surfaces with a side ticking. Still more particularly, the invention is directed to a mattress structure having a binding component resistant to rupture when exposed to high heat and flame.

Still more particularly, the invention is directed to a mattress structure having a binding which, while structurally similar to conventional mattress bindings incorporates as binding components polymeric materials which react synergistically to maintain the structural integrity of the connection between the ticking components for a relatively extended period as compared to binding structures heretofore known.

In accordance with the invention, the ticking margins to be connected are overlaid with a fire retardant fabric tape. The composition of the tape, preferably a polyester, is selected such that the same is thermoplastic and is subject to melt and flow at relatively low temperatures. The sewing thread employed to complete the binding structure comprises a thermo-setting polymer which chars at a temperature substantially higher than the melt temperature of the polymeric tape, i.e. a para-aramid.

It has been discovered that when a binding seam of a type described is subjected to flame conditions, the rapidly melting thermoplastic tape tends to flow and wick into the thermosetting sewing thread forming a protective layer or coating over the thread which renders the binding seam resistant to rupture over a relatively protracted period of time as compared to known bindings. Surprisingly, we have discovered that the combination of low-melt polyester tape and high-heat-resistant aramid, i. e. para-aramid and meta-aramid, sewing threads provides a superior performance to a combination in which the sewing thread is a thermoset aramid, i. e. para-aramid and the tape is a thermoset meta-aramid.

It is accordingly an object of the invention to provide a mattress having a binding resistant to separation or rupture when subjected to flame or high heat conditions. A further object of the invention is the provision of a mattress having a binding assembly comprising a low-melt flame-retardant thermoplastic material in combination with a sewing thread linking the binding components comprised of a high-heat resistant thermosetting material. A still further object of the invention is the provision of a binding assembly wherein the binding tape is comprised of a fire-retardant thermoplastic material which, when subjected to heat above its melt temperature, will flow or wick into and around the structural thread components and protect these components whereby the binding or seam is resistant to rupture for a period of time substantially longer than binding assemblies heretofore known.

DESCRIPTION OF DRAWINGS

FIG. 1 is a perspective view of a mattress.

FIG. 2 is a magnified schematic sectional view of a binding construction in accordance with the invention taken on a line 2—2 of FIG. 1.

DETAILED DESCRIPTION OF DRAWINGS

Figure 3:
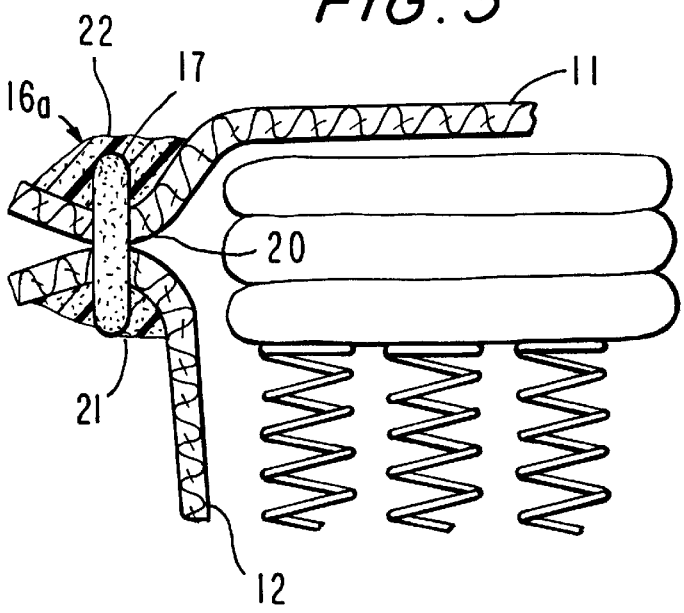
FIG. 3 is a section similar to FIG. 2 showing the condition of the components after having been subjected to flame.

Referring now to the drawings there is shown in FIG. 1, a perspective view of a mattress 10 including an upper ticking component 11 and a side ticking 12. The side ticking is connected to the upper ticking and the lower ticking component (not shown) by a binding 13.

In FIG. 2 there is disclosed an enlarged schematic view of the binding assembly 13 which connects the margins of the upper ticking 11 and side ticking 12, including elements of the batting and mattress springs. The structure of the binding assembly is known per se. The structure includes outwardly-folded portions 14, 15 of the upper and side margins, of the tickings 11,12, the portions 14, 15 being preferably disposed in abutting relation. A binding tape 16 is superposed over the outwardly-folded margins 14, 15, assembly being held together by stitching component 17 extending sequentially through tape 16, upper ticking 11, ticking margin 14, side ticking component or margin 15, side ticking 12 and leg 18 of the tape 16.

As previously noted, the specific configuration of ticking tape and stitching is known per se, the inventive advance hereof being directed primarily to the selection of materials in combination.

Bindings, as illustrated in FIG. 2, formed of conventional material, are subject to catastrophic failure when the binding component is subjected to flame. We have discovered that a combination of components which protect the stitching material 17 will significantly extend the period of time before the stitching is compromised, i.e., the time when the binding will rupture permitting separation of the side and top tickings and extrusion of theretofore compressed batting or foam material. We have further discovered that surprisingly, by selecting a fire-retardant but low-melt tape component 16 in combination with a stitching member 17 which is thermosetting and char-resistant to a temperature substantially higher than the melt temperature of the tape, that there is provided a binding resistant to rupture over a significant time period following exposure of the binding to flame. Without limitation, we have theorized that when the binding of the invention is subjected to flame, the low melt polymeric fire-retardant tape flows along and wicks to the locking stitch 17 shielding the stitch components and extending the time when failure of a stitching 17 results in rupture of the binding.

It has been determined that the effectiveness of shielding of the locking stitch components is best accomplished when the binding tape melts and flows at a temperature of 150 degrees Fahrenheit or more below the char temperature of the locking thread. By way of example and without limitation as will be more specifically set forth hereinafter the tape component is desirably a polyester which has been treated to render it fire-retardant and the stitching component comprises a para-aramid.

By way of specific example, suitable tape component 16 has been fabricated as follows:

Weave Type: Twill.

Width: 1¼ inch.

Warp: 68 ends of 250 denier continuous filament polyester purchased from United Yarn Products of Wayne, N.J.

Filling: one end of 1,000 denier continuous filament polyester purchased from American Draw Tech Company of Wayne, N.J.

Picks: 20 picks per inch.

Melt or Zero Strength Temperature: 473 degrees Fahrenheit.

Fire Retardant treatment.

Sewing Thread: Craq-Spun® Kevlar®

Size: TEX 35 purchased from Atlantic Thread & Supply Company of Baltimore, Md.

WORKING EXAMPLE #2

Weave Type: Twill.

Width: 1¼ inch.

Warp: 68 ends of 21 cotton count spun polyester.

Filling: one end of 5 cotton count spun polyester.

Picks: 20 picks per inch.

Melt or Zero Strength Temperature: 473 degrees Fahrenheit.

Fire Retardant treatment.

Sewing Thread: Basofil®

Size: 17 cotton count.

WORKING EXAMPLE #3

Weave Type: Twill.

Width: 1¼ inch.

Warp: 68 ends of 250 denier continuous filament nylon.

Filling: one end of 1,000 denier continuous filament nylon.

Picks: 20 picks per inch.

Melt or Zero Strength Temperature: 473 degrees Fahrenheit.

Fire Retardant Treatment.

Sewing Thread: Nomex®

Size: Tex 35.

The preferred stitching thread set forth above is char-resistant up to a temperature of about 850 degrees Fahrenheit at which temperature it loses virtually its entire tensile strength.

A further surprising discovery results from a finding that the combination of a low-melt polyester tape, and an aramid such as para-aramid thread, provides superior performance to a tape comprised of an aramid and an aramid stitching thread. More particularly, when subjected to the test procedures as hereinafter set forth, the combination of polyester tape and para-aramid sewing thread provides a binding which is burst-resistant for a period up to twice as long as an identically constructed binding wherein both the tape and stitching comprise aramids.

As will be apparent from a comparison of FIGS. 2 and 3, there is schematically disclosed a change wherein increments of the heat exposed tape 16*a* are illustrated as flowing to areas 20, 21, 22, with some wicking into the thread 17, thereby shielding the thread 17 which provides the principal burst-resistance to the binding structure.

A preferred example of an para-aramid sewing thread 17 is identified as Craq-Spun® Kevlar® (Craq-Spun is a trademark of Atlantic Thread & Supply Company of Baltimore, Md. & Kevlar is a trademark of DuPont in Wilmington Del.). The thread is comprised of a spun para-aramid material. Some other suitable thermoset materials that have high temperature resistant properties for sewing threads include Kevlar®, Nomex®, PBI®, Zylon®, Basofil®, Teflon® or a combination thereof.

Next will be described test apparatus and the test results wherein the burst-resistance of identically constructed bindings, comprising a variety of tapes and sewing threads, have been evaluated.

Figure 4:
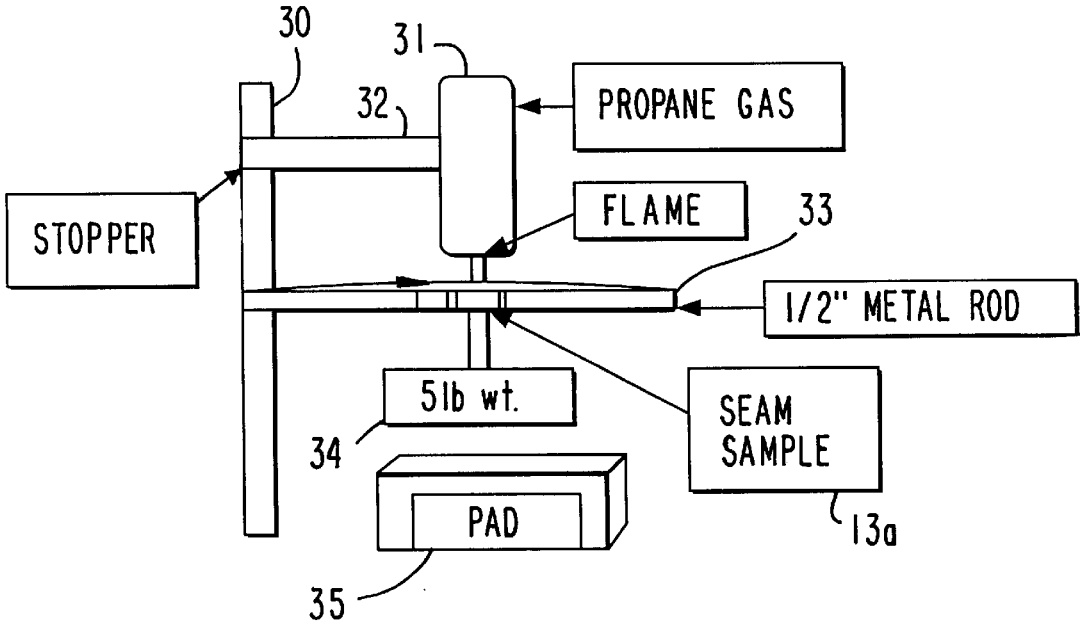
FIG. 4 is a schematic view of a test assembly employed to evaluate the flame-resistant properties of various binding combinations.

Referring to FIG. 4, there is schematically illustrated a test apparatus comprising a vertical stanchion 30 to which is connected a propane gas torch 31 supported on strut 32 vertically adjustably connected to the stanchion 30. A metal rod 33, ½ inch in diameter is coupled to stanchion 30. The rod 33 (see FIG. 5) forms a support for a length of material to be tested, the sample comprising fabric component 11*a* corresponding to the top ticking of a mattress and a fabric component 12*a* corresponding to the side ticking of a mattress. The fabric components 11, 12 are interconnected by a binding structure 13 corresponding to the binding illustrated in FIG. 2. The free ends of the fabric components 11, 12 are connected to a 5 lb. weight 34 disposed over catch pad 35. A binding component 13 is offset approximately 80 degrees from the axis of rod 33 to simulate the angular orientation of the upper and side ticking components of a mattress.

Figure 5:
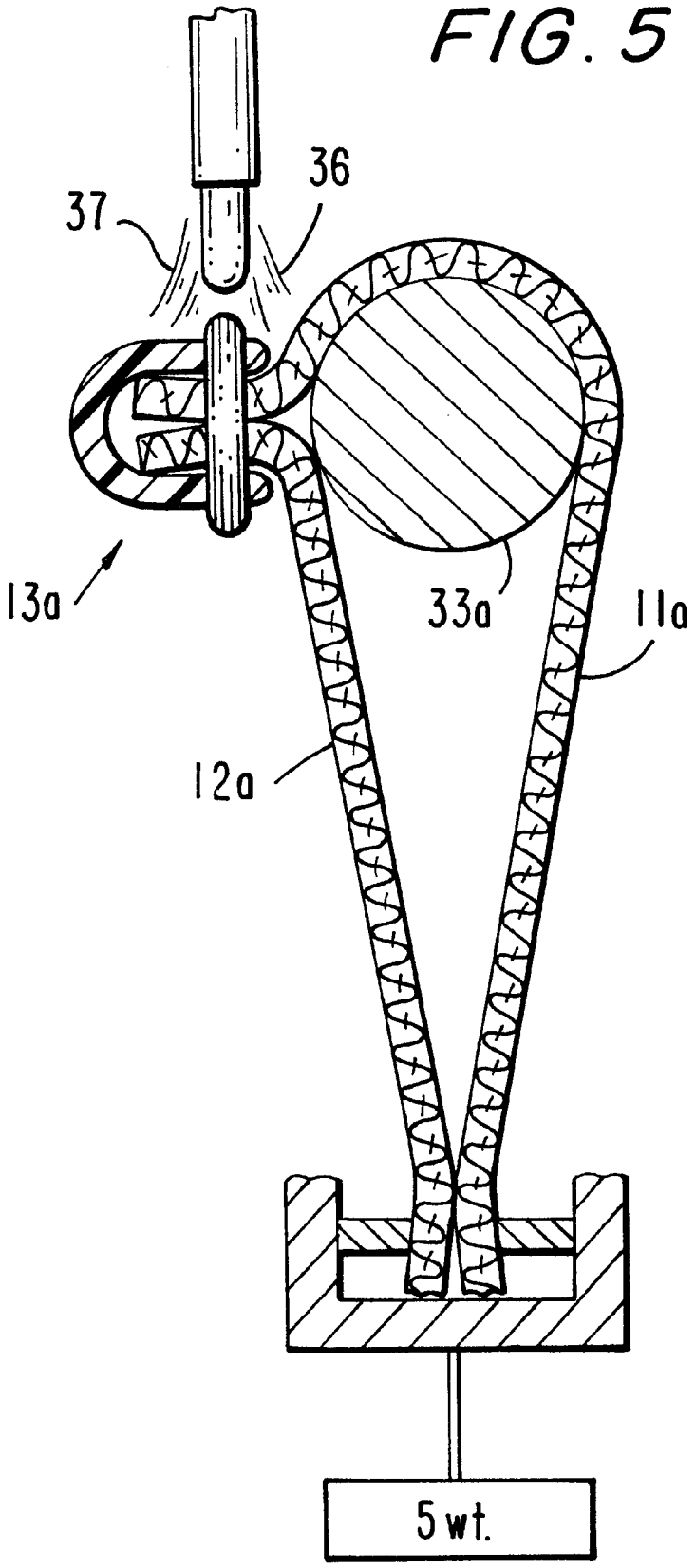
FIG. 5 is an enlarged schematic view of the support for the material being tested and a sample of test material exposed to a test flame.

In accordance with the test procedure, as schematically shown in FIG. 5, the corona 36 of the propane gas flame 37 is impinged directly against binding sample 13A. The flame has been adjusted to provide a 3½ inches total flame length, the corona 36 being the hottest portion of the flame is disposed directly on the binding sample simulation 13A. The timing between application of the flame and dropping of the weight is observed and recorded. In all instances, sample width, i.e., the extent of the sample component mounted on the bar 33 was 1 inch. The fabric components 11 and 12 in all instances were comprised of melamine and para-aramid fabric highly resistant to flame thereby to assure that performance of the binding 13 was a function exclusively of the binding 13 comprised of tape component 16 and the stitching 17.

In all instances where polyester tape was employed, the same was rendered fire-retardant according to industry standards.

A representative treatment is described below:

The woven tape was treated with the following mixture in the dye bath during the color dyeing process:

0.125 gallon of Sodeyco anti-migrant ST liquid purchased from Clariant Corporation of Charlotte, N.C.

0.050 gallon of phorwite EBL purchased from Lyntech Corporation of Paterson, N.J.

3.0 gallons of Flameout 19m purchased from A. Harrison & Company North Providence, R.I.

6.825 gallons of water 10 gallon total

TEST 1—STANDARD POLYESTER TAPE

In this test a conventional binding as currently employed was comprised of untreated polyester fabric with nylon lock stitch. The failure time averaged approximately one second plus or minus about 10%.

Meta-Aramid Tape with Para-Aramid Stitching

This combination showed marked improvements over the polyester sample evincing an average of 59 seconds to failure in the 15 samples tested.

Fire-Retardant Polyester Tape and Para-Aramid Sewing Thread

This combination evinced an average of 71 seconds to failure in the 15 samples tested.

As derived from the collected results, the industry standard employing a binding comprising polyester tape in combination with a nylon sewing thread provided virtually no resistance to bursting when subjected to flame.

The combination of meta-aramid fabric and para-aramid sewing thread showed a binding or seam which provided a substantial protection against burst. It is noteworthy that the meta-aramid tape cost is between 10 and 20 times the cost of the polyester (treated or untreated) tape.

Surprisingly, the combination of low melting fire-retardant treated polyester with para-aramid stitching provided the greatest duration of protection against burst. This unexpected result was achieved at a cost substantially lower than the binding comprised of meta-aramid tape and para-aramid sewing thread.

Material Melt and/or Decomposition Temperatures

| Material | Temperature (degree Fahrenheit) |
|---|---|
| Para-aramid | 800–900 |
| Meta-aramid | 700 |
| Polyester | 473 |
| Nylon | 473 |

-continued

Material Melt and/or Decomposition Temperatures

| Material | Temperature (degree Fahrenheit) |
|---|---|
| Fluorocarbon | 620 |
| Melamine | 1100–1300 |

Other polymers considered to function as sewing threads are:

Thermo-Setting High Temperature & High Performance Fibers

| Generic Name | Trade Name | Manufacturer & Location | Comments |
|---|---|---|---|
| Meta-aramid | Nomex ® | DuPont Wilmington Delaware, USA | 700 deg. F decomposition temperature |
| Meta-aramid | Conex ® | Teijin Osaka, Japan | 930 deg. F Decomposition Temperature |
| Para-aramid | Kevlar ® | DuPont Wilmington Delaware, USA | 850 deg. F zero strength temperature |
| Para-aramid | Technora ® | Teijin Osaka, Japan | 930 deg. F Decomposition Temperature |
| Melamine | Basofil ® | BASF Charlotte, North Carolina, USA | 1100 deg. F Decomposition Temperature |
| Melamine | PBI ® | Celanese Charlotte, North Carolina, USA | 1300 deg. F Decomposition Temperature |
| Melamine | Zylon ® | Toyobo Osaka, Japan | 1200 deg. F Decomposition Temperature |
| Fluorocarbon | Teflon ® | DuPont Wilmington Delaware, USA | 620 deg. F decomposition temperature |

While no standardized tests currently exist for measuring the burst strength of a mattress binding structure, it is believed that the described tests apparatus and/or closely related apparatus and method procedures will be adopted.

The current invention provides a flame resistant binding which greatly extends the time before which a burst will occur, as compared to binding heretofore known. The dramatically improved performance is achieved in an assembly which is only slightly more expensive than those currently employed in conventional mattress structures.

As will be apparent to those skilled in the art and familiarized with the instant disclosure numerous details of structure and composition may be made without departing from the spirit of the instant invention.

It is to be understood that the specific aramids disclosed herein are incorporated to comply with the "best mode" requirements of the patent laws and should not be considered limitative.

The essential advance of the present invention resides in a mattress having bindings which incorporate a low melt readily flowing flame retardant tape in combination with a sewing thread which is thermosetting and retains its tensile strength until high temperature char.

It is anticipated that other combinations of low melt flowable binding tape and high temperature sewing thread would provide similar results.

Accordingly, it is contemplated that the instant disclosure encompasses the use of equivalent materials to the ones specifically recited hereinabove.

What is claimed is:

1. A mattress having burst resistant binding when subjected to flame comprising an upper ticking, side ticking and stuffing, a binding assembly interposed between juxtaposed respective margins of said upper ticking and side ticking, said binding assembly connecting said margins of said upper and side ticking, said binding assembly comprising a fabric binding tape overlapping said margins of said ticking and a sewing thread extending through said tape and portions of said upper and side tickings adjacent said margins, said binding assembly characterized in that said tape comprises a fire retardant thermoplastic polymer and said sewing thread comprises a thermo-set polymer, said tape being subject to melting and flowing at a temperature of at least about 150° Fahrenheit lower than the char temperature of said sewing thread, whereby when said binding assembly is subjected to temperatures in excess of the melt temperature of said tape, molten increments of said tape flow about and encompass increments of said thread.

2. A mattress in accordance with claim 1 wherein said sewing thread is selected from the group consisting of meta-aramids, para-aramids, fluorocarbons, and melamines.

3. A mattress in accordance with claim 1 wherein said tape comprises polyester.

4. A mattress in accordance with claim 1 wherein said tape comprises nylon.

* * * * *